United States Patent [19]

Arai et al.

[11] Patent Number: 4,509,467

[45] Date of Patent: Apr. 9, 1985

[54] HYDRAULIC LIFTER SYSTEM FOR VARIABLE CYLINDER ENGINES

[75] Inventors: Fuminao Arai, Chiryu; Hisashi Kodama, Nagoya; Takuro Ono, Chiryu, all of Japan

[73] Assignee: Aisin Seiki Kabushiki Kaisha, Kariya, Japan

[21] Appl. No.: 548,100

[22] Filed: Nov. 2, 1983

[30] Foreign Application Priority Data

Nov. 9, 1982 [JP] Japan ..... 57-197367

[51] Int. Cl.[3] ..... F02D 13/06

[52] U.S. Cl. ..... 123/90.16; 123/90.27; 123/90.46; 123/90.57; 123/198 F

[58] Field of Search ..... 123/90.15, 90.16, 90.27, 123/90.46, 90.56, 90.57, 198 F

[56] References Cited

U.S. PATENT DOCUMENTS

| | | | |
|---|---|---|---|
| 2,665,669 | 1/1954 | Ellis | 123/90.55 |
| 2,745,391 | 5/1956 | Winkler | 123/90.57 |
| 2,942,595 | 6/1960 | Bergmann, Sr. et al. | 123/90.57 |
| 2,948,274 | 8/1960 | Wood | 123/90.56 |
| 3,520,287 | 7/1970 | Calvin | 123/198 F |
| 4,164,917 | 8/1979 | Glasson | 123/90.15 |
| 4,167,931 | 9/1979 | Iizuka | 123/90.27 |
| 4,249,489 | 2/1981 | Bruder et al. | 123/90.27 |
| 4,387,680 | 6/1983 | Tsunetomi et al. | 123/198 F |

*Primary Examiner*—Ira S. Lazarus

*Attorney, Agent, or Firm*—Oblon, Fisher, Spivak, McClelland & Maier

[57] ABSTRACT

The hydraulic lifter system for variable cylinder engines comprises a hydraulic lifter which is operatively connected to a rocker arm and which includes a body having a pressure chamber and a reservoir chamber, a plunger slidably positioned within the body, and a check valve to allow the fluid flow only into the pressure chamber from the reservoir chamber, a solenoid valve positioned by the side of the hydraulic lifter, means for causing the check valve to open to thereby establish the fluid communication between the pressure and reservoir chambers by means of the solenoid valve, and a stopper member for locking the plunger to stop the operation of the hydraulic lifter in association with the means for causing the check valve to urge to open.

6 Claims, 6 Drawing Figures

HYDRAULIC LIFTER SYSTEM FOR VARIABLE CYLINDER ENGINES

BACKGROUND OF THE INVENTION

1. Field of the Invention

This invention relates to hydraulic lifter systems in general and more particularly to a hydraulic lifter system installed in a variable cylinder engine for reducing fuel consumption by means of controlling the number of cylinders which operates in response to the engine load.

2. Description of the Prior Art

In the prior internal combustion engine, a predetermined valve clearance is provided since there is a difference between thermal expansions of a cylinder head and a cylinder block and thermal expansions of a valve train mechanism. When the valve clearance is not properly maintained during the operation of the engine, noises will be occurred and the loss of the horse power will be occurred due to the blows of the crude gases. Therefore, the hydraulic lifters have been proposed to thereby maintain the valve clearance.

Such hydraulic lifters have a body, a plunger slidably disposed within the body so as to thereby define a reservoir chamber and a pressure chamber therein, and a check valve to allow a fluid flow only into the pressure chamber from the reservior chamber. The plunger is mechanically associated with a cam shaft and therefore the plunger is caused to be moved relative to the position of the body in response to the rotation of the cam shaft. More particularly, when the plunger is sunk relative to the position of the body, the fluid under pressure within the pressure chamber is flowed out while when the plunger is extended relative to the position of the body, the check valve is caused to be opened to thereby allow the fluid flow into the pressure chamber from the reservoir chamber.

The above hydraulic lifters have been applied in the combustion engine of variable cylinder type such that the number of cylinders, which operates, is controlled by means of the hydraulic lifters. More particularly, the check ball is pressed so as to constantly establish the fluid communication between the reservoir chamber and the pressure chamber. Therefore, the fluid pressure within the pressure chamber will be decreased and the rigidity of the hydraulic lifter will be removed so that the operation thereof becomes unavailable. The opening and closing operation of the intake or exhaust valve which corresponds to the unavailable hydraulic lifter is thus stopped.

In the valve train mechanism of pivot type wherein an upper end surface of a rocker arm is in contact with a cam surface, a lower end surface of the rocker arm is in contact with a valve stem and a coupling portion between the rocker arm and the hydraulic lifter acts as fulcrum, however, the rocker arm still carries out the rocking motion around the contact point with the valve stem even when the rigidity of the hydraulic lifter. The stroke of the hydraulic lifter becomes larger due to an arm ratio of the rocker arm and, as a result, the flow of the fluid will not follow the operation of the hydraulic lifter, and the intake or exhaust valve is still opened and closed due to the flow resistance of the fluid. Furthermore, there is a possibility that the interference between the rocker arm and the cam shaft generates the tapping noises.

SUMMARY OF THE INVENTION

Therefore, it is an object of the present invention to provide a new and improved hydraulic lifter system for variable cylinder engines which obviates the above mentioned prior drawbacks.

It is another object of the present invention to provide a new and improved hydraulic lifter system for variable cylinder engines wherein the movement of the hydraulic lifter is restricted when the operation of the hydraulic lifter is caused to be become unavailable.

It is a further object of the present invention to provide a new and improved hydraulic filter system for variable cylinder engines which is simple in construction and is high in durability.

According to the invention, a hydraulic lifter system for variable cylinder engines comprising a rocker arm being capable of rocking in association with a rotation of a cam shaft and being in contact with an intake or exhaust valve, a hydraulic lifter operatively connected to the rocker arm and including a body having a pressure chamber and a reservoir chamber therein, a plunger slidably positioned within the body and exposed in the pressure chamber and a check valve positioned between the pressure and reservoir chambers to thereby allow the fluid flow only into the pressure chamber from the reservoir chamber, a solenoid valve positioned by the side of the hydraulic lifter and actuated in response to electric signals, means for causing the check valve to open to thereby establish the fluid communication between the pressure and reservoir chambers by means of the solenoid valve, and a stopper member for locking the plunger to stop the operation of the hydraulic lifter in association with said means for causing the check valve to open. As a result, when the operation of the hydraulic lifter becomes unavailable, the plunger is locked and then the movement of the hydraulic lifter is stopped.

BRIEF DESCRIPTION OF THE DRAWINGS

Other objects, features and advantages of the invention will become apparent from the following description of a preferred embodiment of the invention with reference to the accompanying drawings wherein.

DETAILED DESCRIPTION OF THE PREFERRED EMBODIMENT

Figure 1:
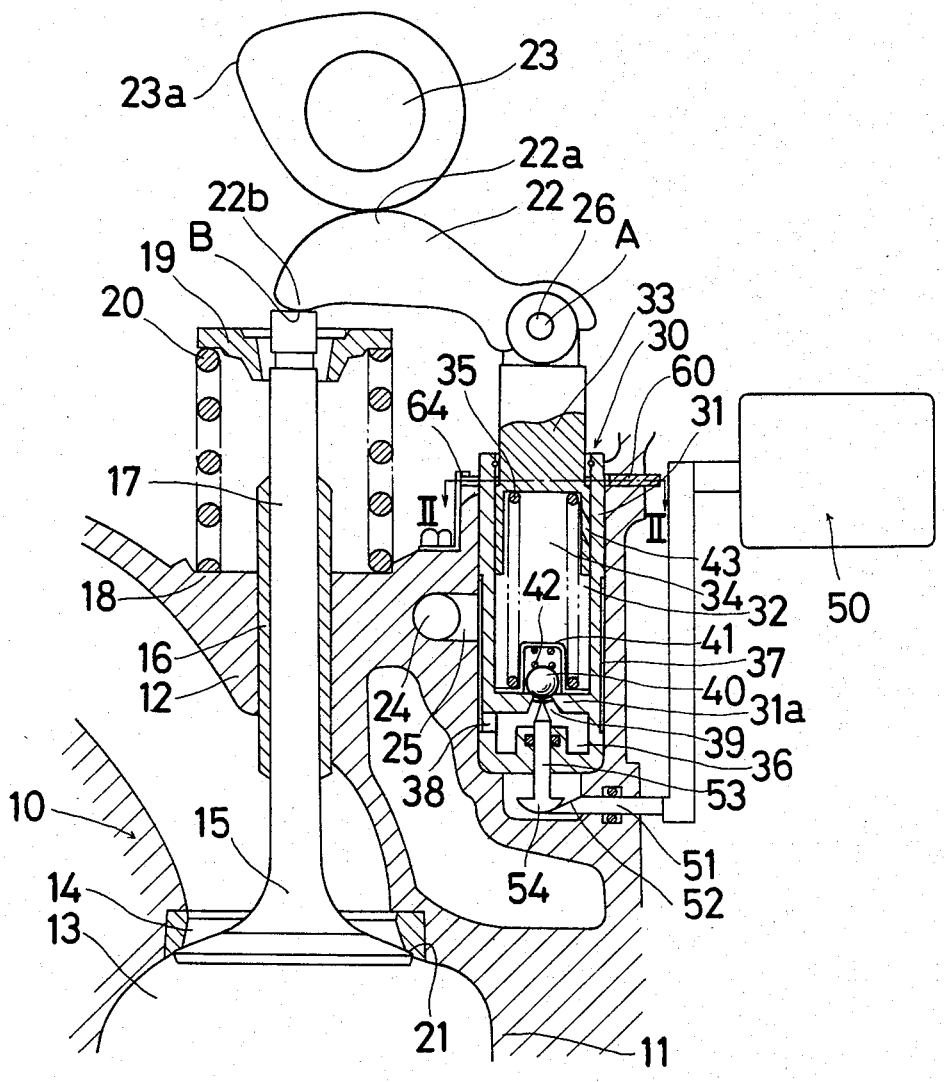
FIG.1 is a sectional view of a hydraulic lifter system for variable cylinder engines according to the present invention.

Referring now to the drawings which illustrate a preferred embodiment of the present invention, FIG. 1 illustrates a hydraulic lifter system for variable cylinder engines which is adapted for an OHC valve train mechanism of pivot type. A piston (not shown) carries out reciprocal up-and-down movements within a cylinder 11 which is formed in a cylinder block 10. A combustion chamber 13 is formed above the piston by means of a cylinder head 12 which forms the upper end part of the cylinder 11. A communication between the combustion chamber 13 and a cylinder head port 14 is controlled by means of an intake or exhaust valve 15. A valve stem 17 which has the valve 15 thereon is inserted in a movable manner in a valve guide 16 formed in the cylinder head 12. A valve spring 20 is inserted between a spring seat 18 formed on the upper end section of the cylinder head 12 and a spring retainer 19 secured to the upper end of the valve stem 17. The valve 15 is constantly biased upwardly by means of the spring 20 so that the valve 15 is normally seated against a valve seat 21. A lower face 22*b* of a rocker arm 22 is in contact with an uppermost part of the valve stem 17 while an upper face 22*a* of the rocker arm 22 is in contact with a cam surface 23*a* of a cam shaft 23. The rocker arm 22 is capable of rocking around a pin shaft 26 which acts as fulcrum and which connects the rocker arm 22 with a hydraulic lifter 30. Therefore, the rocker arm 22 carries out the rocking movement around a point A in response to the rotatory movement of the cam shaft 23, so that the valve 15 repeats its opening and closing function.

The hydraulic lifter 30 which is securely inserted in the cylinder head 12 has a lifter body 31 having an inside cylinder 32 therein and a plunger 33 which carries out a reciprocating movement in the up-and-down direction within the cylinder 32. A pressure chamber 34 is formed inside the plunger 33 and the plunger 33 is constantly biased upwardly by means of a plunger return spring 35 which is disposed within the pressure chamber 34. Formed at the lower part of the lifter body 31 is a reservoir 36 which receives the oil under pressure through an oil hole 24 and an oil passage 25 formed in the cylinder head 12, respectively, and an annular groove 37 and an oil passage 38 formed in the lifter body 31, respectively, the oil hole 24 being formed at the uppermost position of the cylinder head 12. The lifter body 31 has a flange 31*a* which, in turn, has an oil passage 39 between the reservoir 36 and the pressure chamber 34. A ball check valve 40 is positioned at the side of the pressure chamber 34 of the passage 39 and permits the flow of the oil only into the pressure chamber 35 from the reservoir 36. The check valve 40 is always biased toward the closed direction by means of one end of a spring 42 with relatively weak biasing force whose other end is seated against a retainer 41. The biasing force of the plunger return spring 35 is stronger than that of the spring 42 and air escape hole 43 is formed at the plunger 33.

A solenoid valve 50 positioned by the side of the hydraulic lifter 30 receives electric signals from a micro-computer (not shown) and is actuated thereby. The micro-computer is adapted to sense the input signals from the engine such as, for example, the speed of the vehicle, the opening degree of throttle valve, and the temperature of the engine to thereby transfer the electric signals to the selenoid valve 50. A rod 51 of the solenoid valve 50 is slidable in the transverse direction inside the cylinder head 12 and an illustrated left end of the rod 51 has a taper surface 52. A needle 53 which is slidable in the up-and-down direction within the lifter body 31 has an upper end which is engageable with the check valve 40 and a lower spherical end 54 which is in contact with the taper surface 52. Therefore, the transverse movement of the rod 51 is transformed into the up-and-down movement of the needle 53 by means of the contact between the taper surface 52 and the spherical surface 54 to thereby upwardly push the check valve 40. Thus, the check valve 40 is caused to be opened against the spring 42.

A wedge-shaped stopper member 60 is slidably received on the lifter body 31. More particularly, the lifter body 31 has a pair of opposed notches 31*b* and 31*c* within which both legs 61 and 62 of the stopper member 60 are received. The stopper member 60 is always biased to the right in FIG. 1 by means of a free end of a leaf spring 64 a lower bend portion of which is secured on the cylinder head 12 so that the right end of the stopper member 60 may be brought in contact with the rod 51 of the solenoid valve 50.

Figure 2:
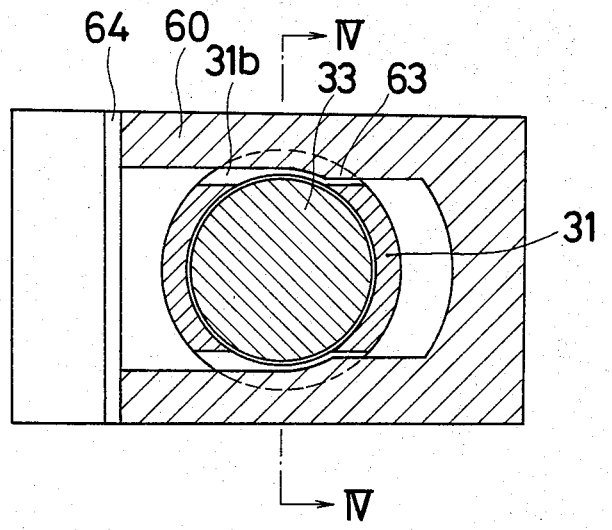
FIG. 2 is a sectional view taken along the line II—II of FIG. 1.
Figure 3:
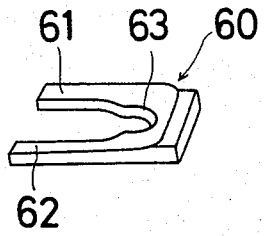
FIG. 3 is a perspective view of a wedge-shaped stopper member applied in the hydraulic lifter system for variable cylinder engines of FIG. 1.
Figure 4:
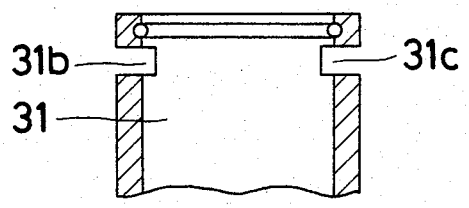
FIG. 4 is a partially sectional view of a lifter body taken along the line IV—IV of FIG. 2.
Figure 5:
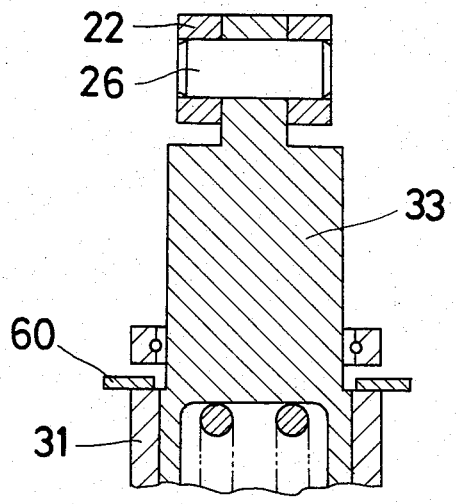
FIG. 5 is a sectional view taken along the line IV—IV of FIG. 2 with the stopper member in an unlocked condition.
Figure 6:
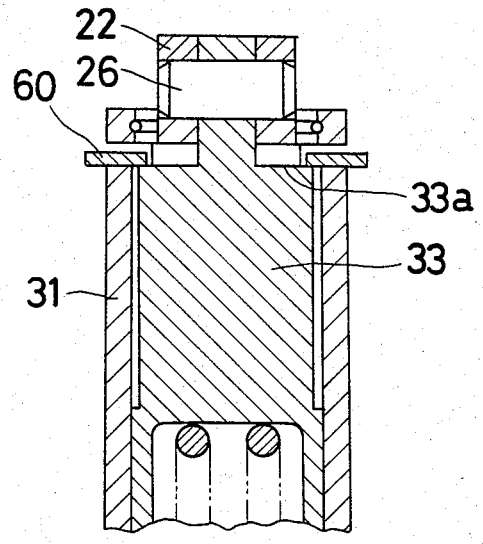
FIG. 6 is a view similar to FIG. 5 but showing the stopper member in a locked condition.

When the check valve 40 of the hydraulic lifter 30 is pressed upwardly as will be clear hereinafter, the plunger 33 is pushed downwardly by means of the operation of the cam shaft 23 so that the hydraulic lifter 30 becomes unavailable. During the above conditions, the stopper member 60 moves to the left in FIG. 2 by the leftward movement of the rod 51 and then small diameter shoulder 63 of the stopper member 60 comes into contact with a shoulder 33*a* of a small diameter portion of the plunger 33. Therefore, the further upward movement of the plunger 33 is restricted and is locked as illustrated in FIG. 6.

In operation, when the engine load is small, the micro-computer will sense, for example, engine input signals such as engine vacuum, vehicle speed, and opening degree of throttle valve to thereby cause to actuate the solenoid valve 50. Therefore, the rod 51 is moved in the transverse direction and this transverse movement of the rod 51 causes the stopper member 60 to move to the left against the leaf spring 64. This transverse movement of the rod 51 is also transformed into the up-and-down movement of the needle 54 and the needle 54 now presses the check valve 40 upwardly to thereby open the oil passage 39. Therefore, the pressure chamber 34 and the reservoir chamber 36 are brought in communication to each other, and the oil pressure within the pressure chamber 34 decreases. As a result, the rigidity of the hydraulic lifter 30 will be removed and the hydraulic lifter 30 becomes unavailable. The plunger 33 is now moved downwardly in response to the rotation of the cam shaft 23 and when the plunger 33 is moved in its position as shown in FIG. 6, the shoulder 63 of the stopper member 60 is brought in contact with the shoulder 33*a* of plunger 33 since the stopper member 60 is now urged to the left by means of the rod 51. Therefore, the plunger 33 is locked. Under these conditions the fulcrum of the rocker arm 22 is changed from the point A into the point B where the lower face 22*b* of the rocker arm 22 is in contact with the uppermost part of the valve stem 17. The rocker arm 22 repeatedly carries out the rocking motion around the point B and thus the opening and closing movement of the valve 15 will be stopped.

When the soleniod valve 50 is de-energized by means of signals from the micro-computer, the rod 51 is returned in its original position and the stopper member 60 is also returned in its original position by means of the leaf spring 64. Thus, the hydraulic lifter 30 is returned in its original position as shown in FIG. 1.

While the invention has been particularly shown and described with respect to a preferred embodiment thereof, it will be understood by those in the art that various changes in form and detail can be made therein without departing from the spirit and scope of the invention.

What is claimed as new and desired to be secured by Letter Patent of the United States is:

1. A hydraulic lifter system for variable cylinder engines comprising:

a rocker arm being capable of rocking in association with a rotation of a cam shaft and being in contact with an intake or exhaust valve, a hydraulic lifter operatively connected to said rocker arm and including a body having a pressure chamber and a reservoir chamber therein, a plunger slidably positioned within said body and exposed to said pressure chamber and a check valve positioned between said pressure and reservoir chambers to thereby allow the fluid flow only into said pressure chamber from said reservoir chamber, a solenoid valve positioned by the side of said hydraulic lifter and actuated in response to electric signals, means for causing said check valve to open to thereby establish the fluid communication between said pressure and reservoir chambers by means of said solenoid valve, and a stopper member for locking said plunger to stop the operation of said hydraulic lifter in association with said means for causing said check vavle to open.

2. A hydraulic lifter system for variable cylinder engines as set forth in claim 1, said body has a flange which defines said pressure chamber at the upper side of said body and said reservoir chamber at the lower side of said body and said check valve is positioned at the side of said pressure chamber.

3. A hydraulic lifter system for variable cylinder engines as set forth in claim 1, wherein said means for causing said check valve to open has a needle which is engageable with said check valve on one side, said needle having a spherical end being in contact with a taper surface of a rod of said solenoid valve so that the transverse movement of said rod is transformed into the up-and-down movement of said needle.

4. A hydraulic lifter system for variable cylinder engines as set forth in claim 1, wherein said stopper member has a pair of legs which are slidably received within a pair of notches which are, in turn, formed in said body of said hydraulic lifter and a small diameter shoulder which is brought in contact with a shoulder of said plunger.

5. A hydraulic lifter system for variable cylinder engines at set forth in claim 4, wherein said stopper member is biased by means of a spring in its unlocking position and is urged by means of a rod of said solenoid valve in its locking position where said small diameter shoulder of said stopper means is brought in contact with said shoulder of said plunger.

6. A hydraulic lifter system for variable cylinder engines as set forth in claim 5, wherein said spring is a leaf spring one end of which is secured to a cylinder head and the other free end of which is in engagement with said pair of legs of said stopper member.

* * * * *